US012460817B2

(12) United States Patent
Watanabe et al.

(10) Patent No.: US 12,460,817 B2
(45) Date of Patent: Nov. 4, 2025

(54) ASSEMBLY, METHOD FOR MANUFACTURING ASSEMBLY, BURNER, AND METHOD FOR MANUFACTURING BURNER

(71) Applicant: MITSUBISHI HEAVY INDUSTRIES, LTD., Tokyo (JP)

(72) Inventors: Masahiro Watanabe, Tokyo (JP); Taiki Kinoshita, Tokyo (JP); Sosuke Nakamura, Tokyo (JP); Norihiko Motoyama, Tokyo (JP); Shiro Maeno, Tokyo (JP); Mitsuo Hasegawa, Tokyo (JP); Yusuke Takahashi, Tokyo (JP); Kenichi Gotoh, Tokyo (JP); Taiji Suizu, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 18/841,850

(22) PCT Filed: Feb. 27, 2023

(86) PCT No.: PCT/JP2023/006910
§ 371 (c)(1),
(2) Date: Aug. 27, 2024

(87) PCT Pub. No.: WO2023/171430
PCT Pub. Date: Sep. 14, 2023

(65) Prior Publication Data

US 2025/0172293 A1 May 29, 2025

(30) Foreign Application Priority Data

Mar. 11, 2022 (JP) ..... 2022-037718

(51) Int. Cl.
*F23R 3/00* (2006.01)
*F23R 3/06* (2006.01)
*F23R 3/16* (2006.01)

(52) U.S. Cl.
CPC ..... *F23R 3/002* (2013.01); *F23R 3/06* (2013.01); *F23R 3/16* (2013.01); *F23R 2900/00015* (2013.01); *F23R 2900/00018* (2013.01)

(58) Field of Classification Search
CPC .... F23R 3/002; F23R 3/06; F23R 3/16; F23R 2900/00015; F23R 2900/00018
See application file for complete search history.

(56) References Cited

U.S. PATENT DOCUMENTS 4,413,477 A * 11/1983 Dean ..... F23R 3/42 60/757
5,975,335 A * 11/1999 Witenhafer ..... B01J 19/0013 220/592.28

(Continued)

FOREIGN PATENT DOCUMENTS

JP 6-39539 2/1994
JP 8-278029 10/1996

(Continued)

OTHER PUBLICATIONS

International Search Report issued May 16, 2023 in International Application No. PCT/JP2023/006910 with English translation.

(Continued)

*Primary Examiner* — Gerald L Sung
*Assistant Examiner* — Rene D Ford
(74) *Attorney, Agent, or Firm* — Wenderoth, Lind & Ponack, L.L.P.

(57) ABSTRACT

This assembly comprises a wall body in which is formed a through-hole passing through in a thickness direction, and a (Continued)

component fixed to one surface of the wall body so as to cover the through-hole, a welded part welded so as to fix the component to the one surface being accommodated within the through-hole.

4 Claims, 3 Drawing Sheets

(56) References Cited

U.S. PATENT DOCUMENTS

| | | | |
|---|---|---|---|
| 6,032,361 | A | 3/2000 | Makino et al. |
| 2009/0151357 | A1 | 6/2009 | Pieussergues et al. |
| 2011/0000215 | A1 | 1/2011 | Lacy et al. |
| 2012/0125006 | A1 | 5/2012 | Saito et al. |
| 2013/0074502 | A1 | 3/2013 | Hada et al. |
| 2017/0299182 | A1 | 10/2017 | Miyauchi et al. |
| 2019/0113231 | A1* | 4/2019 | Kajimura ..... F23R 3/50 |
| 2024/0027069 | A1 | 1/2024 | Fukuba et al. |

FOREIGN PATENT DOCUMENTS

| | | |
|---|---|---|
| JP | 2004-162959 | 6/2004 |
| JP | 2005-133957 | 5/2005 |
| JP | 2005-315473 | 11/2005 |
| JP | 2009-145039 | 7/2009 |
| JP | 2011-12949 | 1/2011 |
| JP | 2011-102669 | 5/2011 |
| JP | 2013-72316 | 4/2013 |
| JP | 2016-3785 | 1/2016 |
| JP | 2017-180899 | 10/2017 |
| JP | 6623485 | 12/2019 |
| WO | 2017/170476 | 10/2017 |
| WO | 2021/201093 | 10/2021 |

OTHER PUBLICATIONS

International Preliminary Report on Patentability issued Sep. 26, 2024 in International Application No. PCT/JP2023/006910 with English translation.

* cited by examiner

ASSEMBLY, METHOD FOR MANUFACTURING ASSEMBLY, BURNER, AND METHOD FOR MANUFACTURING BURNER

TECHNICAL FIELD

The present disclosure relates to a joined body, a method for manufacturing a joined body, a combustor, and a method for manufacturing a combustor.

The present application claims priority based on Japanese Patent Application No. 2022-037718 filed in Japan on Mar. 11, 2022, the contents of which are incorporated herein by reference.

BACKGROUND ART

For example, PTLs 1 to 3 describe a combustor in which a throttle portion having an inclined surface for guiding a flow of combustion gas to a radial inner side is provided on an inner peripheral surface of a tubular body through which the combustion gas flows, for the purpose of reducing carbon monoxide.

CITATION LIST

Patent Literature

[PTL 1] Japanese Unexamined Patent Application Publication No. 2017-180899
[PTL 2] International Publication No. WO2021/201093
[PTL 3] Japanese Patent No. 6623485

SUMMARY OF INVENTION

Technical Problem

Such a throttle portion is fixed to the inner peripheral surface of the tubular body by being welded from an inside of the tubular body. However, in a case where the throttle portion is fixed to a position deeper than an opening end of the tubular body, there is a problem in that workability of welding deteriorates. This problem is not limited to the manufacture of the combustor, and the same problem applies to a case where any component is welded to an inner peripheral surface of any member having a tubular shape. Furthermore, even in a case where any component is fixed to one surface of a plate-shaped member instead of the member having a tubular shape, when an obstacle is placed to face the one surface, the obstacle is in the way, and the same problem applies.

In view of the above circumstances, an object of at least one embodiment of the present disclosure is to provide a joined body, a method for manufacturing a joined body, a combustor, and a method for manufacturing a combustor, in which workability of welding a component to a wall body is improved.

Solution to Problem

In order to achieve the above object, a joined body according to the present disclosure includes: a wall body having a through-hole formed in a thickness direction; and a component fixed to one surface of the wall body to block the through-hole, in which a welded portion welded to fix the component to the one surface is accommodated in the through-hole.

In addition, a method for manufacturing a joined body according to the present disclosure is a method for manufacturing a joined body in which a component is fixed to a wall body, the method including: a step of forming a through-hole in the wall body in a thickness direction of the wall body; and a step of allowing the component to block the through-hole from one surface of the wall body and welding an inner peripheral surface of the through-hole and the component from the other surface side of the wall body, in which a welded portion where the inner peripheral surface of the through-hole and the component are welded is accommodated in the through-hole.

Advantageous Effects of Invention

According to the joined body and the method for manufacturing a joined body of the present disclosure, welding can be performed on the wall body from a side opposite to the side on which the component is fixed. Therefore, workability of welding can be improved even in a case where it is difficult to perform welding from the side on which the component is fixed.

DESCRIPTION OF EMBODIMENTS

Hereinafter, a joined body and a method for manufacturing a joined body according to embodiments of the present disclosure will be described with reference to the drawings. The embodiments which will be described below show aspects of the present disclosure and do not limit the disclosure, and any change can be made within the scope of the technical idea of the present disclosure.

First Embodiment

<Configuration of Joined Body According to First Embodiment of Present Disclosure>

Figure 1:
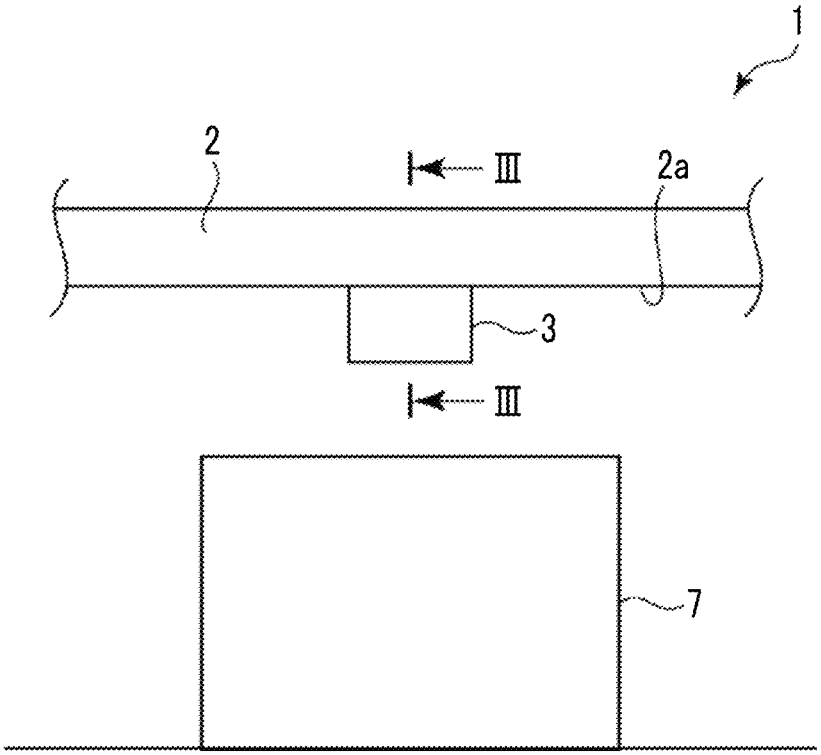
FIG. 1 is an end view showing an example of a joined body according to a first embodiment of the present disclosure.
Figure 2:
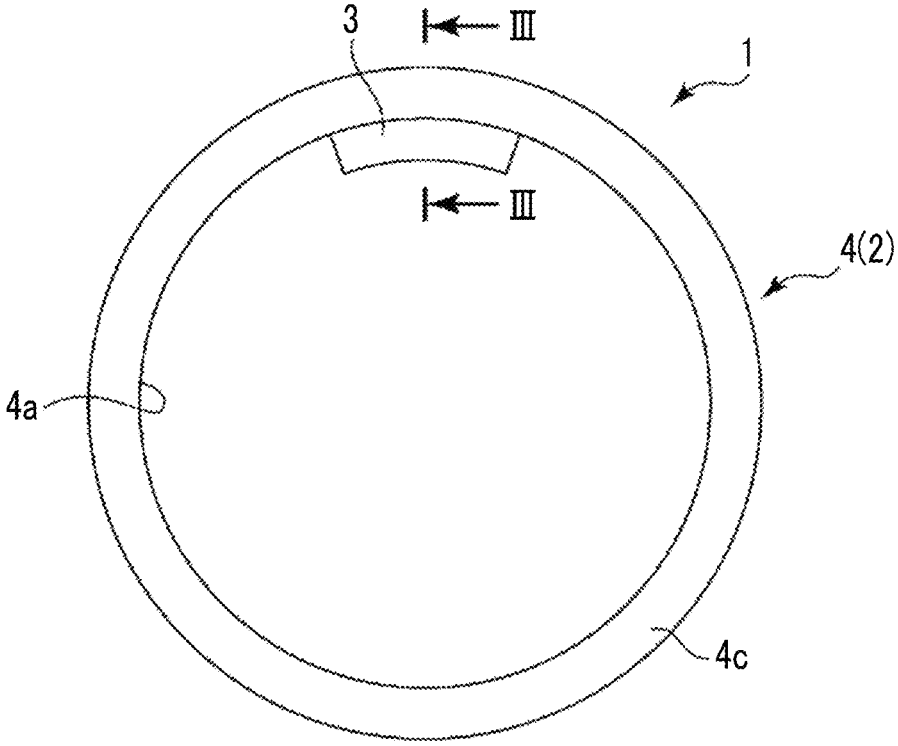
FIG. 2 is an end view showing another example of the joined body according to the first embodiment of the present disclosure.

As shown in FIG. 1, a joined body 1 according to a first embodiment of the present disclosure has a configuration in which any component 3 is fixed to one surface 2*a* of a plate-shaped wall body 2 by welding, as an example. The wall body 2 is not limited to a plate shape, and may have any shape. As an example of any shape, the wall body 2 may be a tubular body 4 having a tubular shape, more specifically, a cylindrical shape as shown in FIG. 2. In this case, the joined body 1 has a configuration in which the component 3 is fixed to an inner peripheral surface 4*a* of the tubular body 4 by welding.

Figure 3:
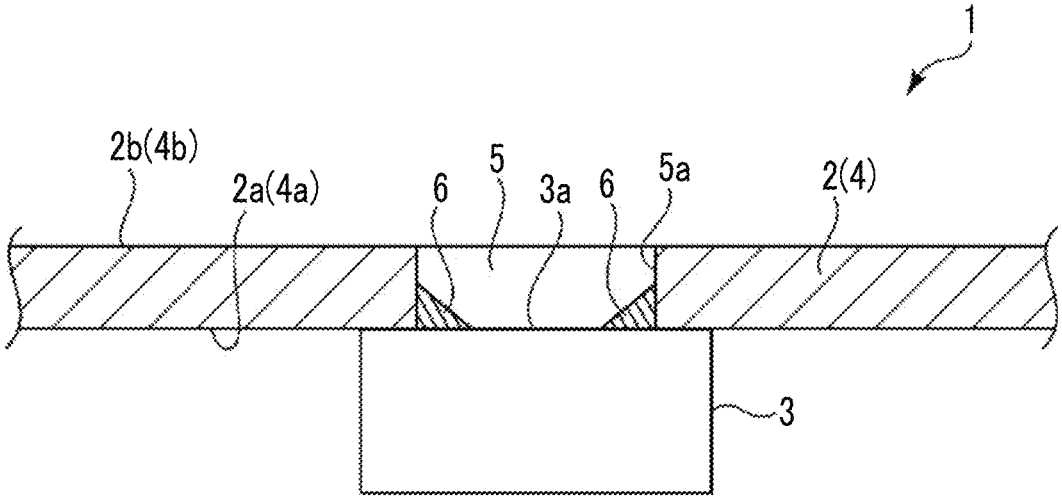
FIG. 3 is a cross-sectional view taken along line III-III of FIGS. 1 and 2.

As shown in FIG. 3, in the wall body 2, a through-hole 5 is formed to pass through the wall body 2 in a thickness direction. The component 3 is fixed to the one surface 2*a* of the wall body 2 to block the through-hole 5 by welding. A welded portion 6 for fixing the component 3 and the wall body 2 is accommodated in the through-hole 5, and the welded portion 6 connects a surface 3*a* in a surface of the component 3 exposed to the through-hole 5 to an inner peripheral surface 5*a* of the through-hole 5 over an entire circumference of an opening of the through-hole 5 that is open to the one surface 2*a* of the wall body 2.

<Method for Manufacturing Joined Body According to First Embodiment of Present Disclosure>

Next, a method for manufacturing the joined body 1 according to the first embodiment of the present disclosure will be described. This method is beneficial, for example, in a case where there is an obstacle 7 facing the component 3 on one surface 2*a* side of the wall body 2 and it is difficult to weld the component 3 from the one surface 2*a* side as shown in FIG. 1, in a case where an inner diameter of the tubular body 4 is small as shown in FIG. 2, or in a case where a position at which the component 3 is to be attached is a position deeper than an opening end 4*c* of the tubular body 4 and it is difficult to weld a component from an inside of the tubular body 4.

As shown in FIG. 3, in order to manufacture the joined body 1, first, the through-hole 5 is formed in the wall body 2 in the thickness direction. Next, the component 3 is allowed to block the through-hole 5 from the one surface 2*a* side of the wall body 2 (from an inner peripheral surface 4*a* side in a case where the wall body 2 is the tubular body 4), and is welded from the other surface 2*b* side of the wall body 2 (from an outer peripheral surface 4*b* side in a case where the wall body 2 is the tubular body 4) so that the surface 3*a* in the surface of the component 3 exposed to the through-hole 5 and the inner peripheral surface 5*a* of the through-hole 5 are connected to each other over the entire circumference of the opening of the through-hole 5 that is open to the one surface 2*a* of the wall body 2. In this case, it is preferable that the welded portion 6 is accommodated in the through-hole 5, that is, no part of the welded portion 6 protrudes from the opening of the through-hole 5 that is open to the other surface 2*b* of the wall body 2.

As described above, since welding can be performed on the wall body 2 from the side (the surface 2*b* side or the outer peripheral surface 4*b* side) opposite to the side (the surface 2*a* side or the inner peripheral surface 4*a* side) on which the component 3 is fixed, workability of welding can be improved even in a case where it is difficult to perform welding from the side on which the component 3 is fixed.

Second Embodiment

Next, a joined body and a method for manufacturing a joined body according to a second embodiment will be described. The joined body according to the second embodiment is limited to a tubular body of a combustor of a gas turbine, compared to the first embodiment. In the second embodiment, the same components as those in the first embodiment are designated by the same reference signs, and the detailed descriptions thereof will not be repeated.

<Configuration of Combustor Including Joined Body According to Second Embodiment of Present Disclosure>

Figure 4:
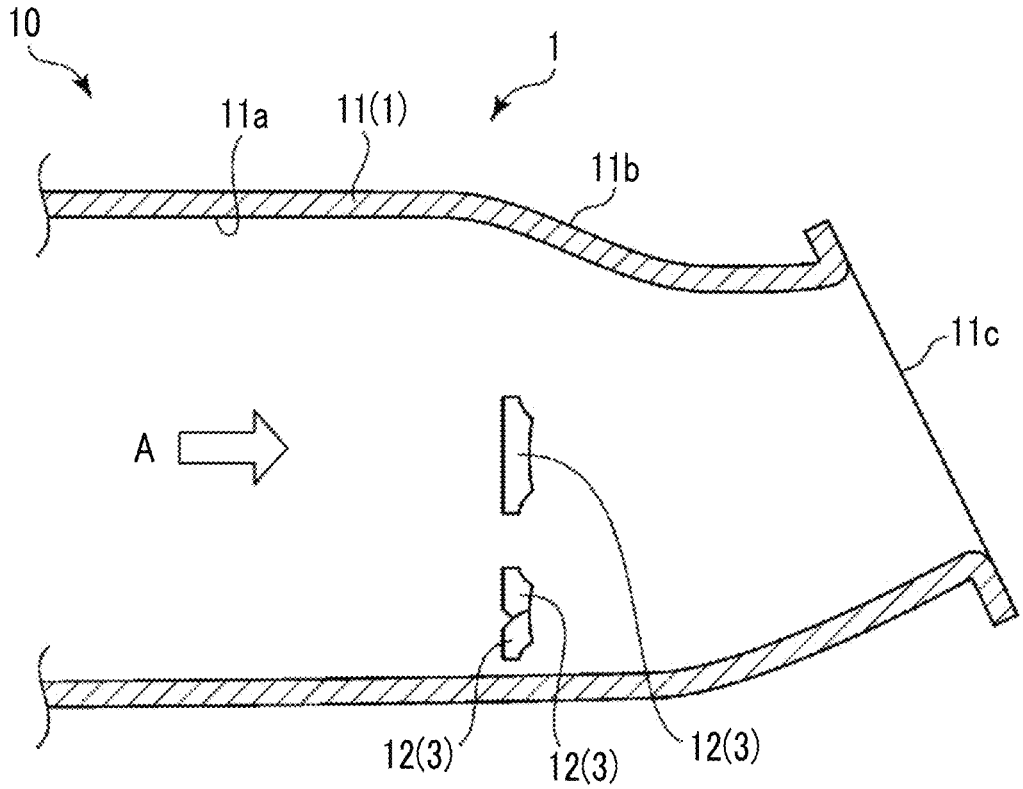
FIG. 4 is a view showing a configuration of a part of a combustor including a joined body according to a second embodiment of the present disclosure.

As shown in FIG. 4, the joined body 1 according to the second embodiment of the present disclosure is a tubular body 11 of a combustor 10 provided in a gas turbine. The tubular body 11 is provided downstream of a combustion nozzle (not shown) of the combustor 10 in a circulation direction A of combustion gas. Inside the tubular body 11, a plurality of throttle portions 12 corresponding to the components 3 (see FIGS. 1 to 3) of the first embodiment are fixed to an inner peripheral surface 11*a* of the tubular body 11 by welding. A configuration in which the throttle portion 12 is fixed to the inner peripheral surface 11*a* of the tubular body 11 by welding is the same as the configuration of the first embodiment.

Figure 5:
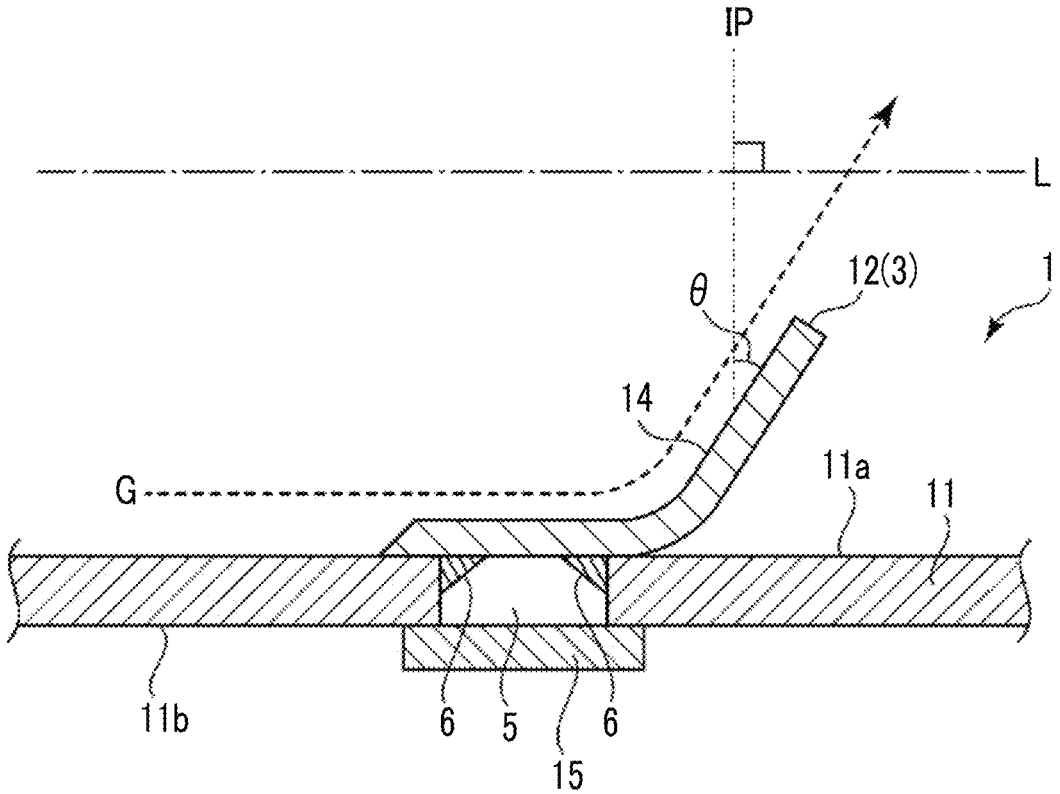
FIG. 5 is a view showing a configuration of a throttle portion in the joined body according to the second embodiment of the present disclosure.

As shown in FIG. 5, the throttle portion 12 is provided to protrude from the inner peripheral surface 11*a* of the tubular body 11 toward a radial inner side of the tubular body 11. The throttle portion 12 has a receiving surface 14 facing the combustion gas flowing through the tubular body 11. The receiving surface 14 is inclined at an acute angle θ with respect to a virtual plane IP perpendicular to an axial direction L of the tubular body 11.

<Method for Manufacturing Combustor Including Joined Body According to Second Embodiment of Present Disclosure>

The combustor 10 can be manufactured by welding the throttle portion 12 to the inner peripheral surface 11*a* from an outer peripheral surface 11*b* side of the tubular body 11 in the same manner as the method described in the first embodiment.

<Operational Effect of Joined Body According to Second Embodiment of Present Disclosure Used in Combustor>

As shown in FIG. 4, the closer the position where the throttle portion 12 is provided is to an upstream side from a downstream side end portion 11*c* of the tubular body 11, the more difficult it is to weld the throttle portion 12 to the inner peripheral surface 11*a* from the inner peripheral surface 11*a* of the tubular body 11. Contrary to this, since a configuration of the second embodiment in which the throttle portion 12 is fixed to the inner peripheral surface 11*a* of the tubular body 11 by welding is the same as the configuration of the first embodiment, the work of welding the throttle portion 12 to the inner peripheral surface 11*a* can be performed from the outer peripheral surface 11*b* side of the tubular body 11, which improves the workability of the welding.

As shown in FIG. 5, during an operation of the combustor 10, combustion gas G circulates inside the tubular body 11. When a temperature of the combustion gas G in the vicinity of the inner peripheral surface 11*a* of the tubular body 11 is lower than that in a center portion of the tubular body 11, a time at which carbon monoxide contained in the combustion gas G is converted into carbon dioxide is delayed, resulting in an increase in concentration of the carbon monoxide in the combustion gas. Contrary to this, in the second embodiment, since the throttle portion 12 includes the receiving surface 14 of the above-described configuration, the combustion gas G in the vicinity of the throttle portion 12 is deflected toward the radial inner side of the tubular body 11, where the temperature is higher, thereby promoting combustion and effectively reducing carbon monoxide.

<Modification Example of Combustor Including Joined Body According to Second Embodiment of Present Disclosure>

As shown in FIG. 5, a lid portion 15 may be fixed to the outer peripheral surface 11*b* of the tubular body 11 to block the through-hole 5 by welding. Even if there is a slight crack in the welded portion 6, in a case where the through-hole 5 is blocked by the lid portion 15, it is possible to suppress a risk that a portion of the combustion gas G inside the tubular body 11 leaks to the outside of the tubular body 11 via the through-hole 5. The lid portion 15 may be provided in the joined body 1 (see FIGS. 1 to 3) of the first embodiment.

Third Embodiment

Next, a joined body and a method for manufacturing a joined body according to a third embodiment will be described. The joined body according to the third embodiment has MT fins formed in the tubular body 11, compared to the second embodiment. In the third embodiment, the same components as those in the second embodiment are designated by the same reference signs, and the detailed descriptions thereof will not be repeated.

<Configuration of Combustor Including Joined Body According to Third Embodiment of Present Disclosure>

Figure 6:
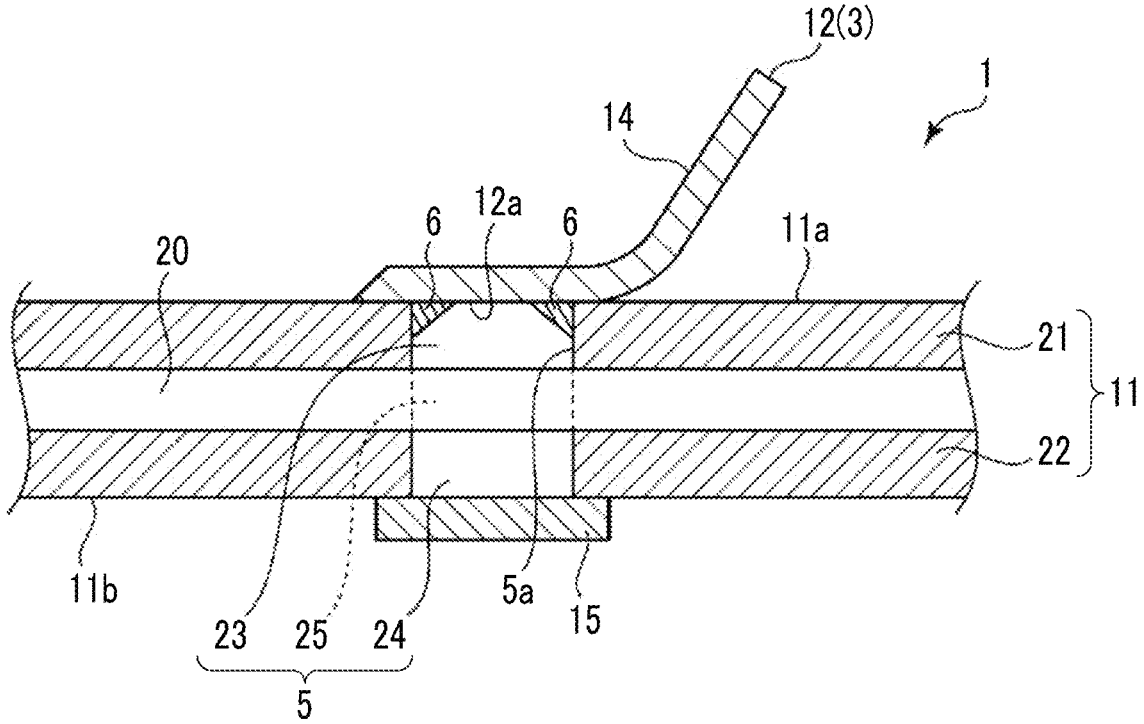
FIG. 6 is a cross-sectional view of a part of a combustor including a joined body according to a third embodiment of the present disclosure.

As shown in FIG. 6, in the combustor 10 including the joined body 1 according to the third embodiment of the present disclosure, a plurality of flow paths 20 called MT fins are formed to extend between the inner peripheral surface 11*a* and the outer peripheral surface 11*b* of the tubular body 11. FIG. 6 shows a configuration in which the component 3, that is, the throttle portion 12, is provided in a portion of the tubular body 11 in which the plurality of flow paths 20 are formed. The tubular body 11 includes an inner wall portion 21 including the inner peripheral surface 11*a* of the tubular body 11 and an outer wall portion 22 including the outer peripheral surface 11*b* of the tubular body 11, and the inner wall portion 21 and the outer wall portion 22 are provided at an interval in a thickness direction of the tubular body 11 so that the flow path 20 is formed therebetween. The through-hole 5 is provided to pass through each of the inner wall portion 21 and the outer wall portion 22 in the thickness direction. Accordingly, the through-hole 5 has a configuration including a first hole portion 23 formed to pass through the inner wall portion 21 in the thickness direction, a second hole portion 24 formed to pass through the outer wall portion 22 in the thickness direction, and an intermediate hole portion 25 formed between the first hole portion 23 and the second hole portion 24 to form a part of the flow path 20. The welded portion 6 is accommodated in the first hole portion 23. That is, it is preferable that the welded portion 6 has no portion protruding from the first hole portion 23 into the intermediate hole portion 25 or into the second hole portion 24. The lid portion 15 is fixed to the outer peripheral surface 11*b* of the tubular body 11 to block the through-hole 5.

<Method for Manufacturing Joined Body According to Third Embodiment of Present Disclosure>

Next, a method for manufacturing the joined body 1 according to the third embodiment of the present disclosure will be described. The through-hole 5 is formed in the thickness direction in the portion of the tubular body 11 in which the plurality of flow paths 20 are formed. Next, the throttle portion 12 is allowed to block the through-hole 5 from the inner peripheral surface 11*a* side of the tubular body 11, and is welded from the outer peripheral surface 11*b* side of the tubular body 11 so that a surface 12*a* in a surface of the throttle portion 12 exposed to the through-hole 5 and the inner peripheral surface 5*a* of the through-hole 5 are connected to each other over an entire circumference of an opening of the through-hole 5 that is open to the inner peripheral surface 11*a* of the tubular body 11. In this case, it is preferable that the welded portion 6 is accommodated in the first hole portion 23. When a part of the welded portion 6 protrudes into the intermediate hole portion 25 or the second hole portion 24, a flow path cross-sectional area of the flow path 20 is reduced or the flow path 20 is blocked. Therefore, it is necessary to check whether the welded portion 6 is accommodated in the first hole portion 23 after welding. In a case where a part of the welded portion 6 protrudes into the intermediate hole portion 25 or the second hole portion 24, it is preferable to remove the protruding part. After the welding of the throttle portion 12, the lid portion 15 is fixed to the outer peripheral surface 11*b* of the tubular body 11 to block the through-hole 5 by welding. Accordingly, the flow path 20 does not communicate with the inside of the tubular body 11 via the first hole portion 23 and does not communicate with the outside of the tubular body 11 via the second hole portion 24.

As described above, it is possible to check whether the welded portion 6 is accommodated in the first hole portion 23 before the lid portion 15 is fixed. Therefore, it is possible to prevent the welded portion 6 from blocking the flow path. Accordingly, it is possible to prevent a cooling medium from not flowing through the flow path 20 due to the welded portion 6. The cooling medium flows through the flow path 20 without being obstructed by the welded portion 6, so that the tubular body 11 itself can be protected from radiant heat of the combustion gas. In addition, it is possible to check whether or not the flow path 20 is blocked due to deformation of the tubular body 11 caused by heat during welding. Therefore, the tubular body 11 itself can be protected from the heat of the combustion gas by the cooling medium flowing in the flow path 20.

<Modification Example of Joined Body According to Second and Third Embodiments of Present Disclosure>

In the second and third embodiments, the component 3 is the throttle portion 12. However, the component 3 is not limited to this form. As long as the component 3 is fixed to the inner peripheral surface 11*a* of the tubular body 11 by welding, the workability of welding can be improved by welding any component 3 other than the throttle portion 12 by the method of the present disclosure.

For example, contents described in each of the above-described embodiments are understood as follows.

[1] A joined body according to an aspect includes:

a wall body (2) having a through-hole (5) formed in a thickness direction; and a component (3) fixed to one surface (2*a*) of the wall body (2) to block the through-hole (5), in which a welded portion (6) welded to fix the component (3) to the one surface (2*a*) is accommodated in the through-hole (5).

According to the joined body of the present disclosure, welding can be performed on the wall body from a side opposite to the side on which the component is fixed. Therefore, workability of welding can be improved even in a case where it is difficult to perform welding from the side on which the component is fixed.

[2] A joined body according to another aspect is the joined body of [1], in which the wall body (2) is a tubular body (4, 11) having a tubular shape, and the one surface (2*a*) is an inner peripheral surface (4*a*, 11*a*) of the tubular body (4).

According to such a configuration, even in a case where an inner diameter of the tubular body is small or in a case where a position at which the component is to be attached is a position deeper than an opening end of the tubular body, welding can be performed from an outer peripheral surface side of the tubular body. Therefore, the workability of welding can be improved.

[3] A combustor according to an aspect includes the joined body (1) of [2].

According to the combustor of the present disclosure, even in a case where a position at which the component is to be attached is a position deeper than the opening end of the tubular body, welding can be performed from the outer peripheral surface side of the tubular body. Therefore, the workability of welding can be improved.

[4] A combustor according to another aspect is the combustor of [3], in which the tubular body (11) includes an inner wall portion (21) including the inner peripheral surface (11*a*) of the tubular body (11), and an outer wall portion (22) including an outer peripheral surface (11*b*) of the tubular body (11), the inner wall portion (21) and the outer wall portion (22) are provided at an interval in a thickness direction of the tubular body (11) so that a flow path (20) is formed therebetween, the through-hole (5) includes a first hole portion (23) formed to pass through the inner wall portion (21) in the thickness direction, a second hole portion (24) formed to pass through the outer wall portion (22) in the thickness direction, and an intermediate hole portion (25) forming a part of the flow path (20) between the first hole portion (23) and the second hole portion (24), the welded portion (6) is accommodated in the first hole portion (23), and a lid portion (15) is fixed to the outer peripheral surface (11*b*) of the tubular body (11) to block the through-hole (5).

According to such a configuration, it is possible to check whether the welded portion is accommodated in the first hole portion before the lid portion is fixed. Therefore, it is possible to prevent the welded portion from blocking the flow path.

[5] A combustor according to still another aspect is the combustor of [4], in which the flow path (20) is configured to allow a cooling medium to flow therethrough.

According to such a configuration, it is possible to prevent the cooling medium from not flowing through the flow path due to the welded portion.

[6] A combustor according to still another aspect is the combustor of any one of [3] to [5], in which the component (3) is a throttle portion (12) that protrudes from the inner peripheral surface (11*a*) of the tubular body (11) toward a radial inner side of the tubular body (11), the throttle portion (12) has a receiving surface (14) facing a combustion gas (G) flowing through the tubular body (11), and the receiving surface (14) is inclined at an acute angle (θ) with respect to a virtual plane (IP) perpendicular to an axial direction (L) of the tubular body (11).

According to such a configuration, the combustion gas in the vicinity of the throttle portion is deflected toward the radial inner side of the tubular body, where a temperature is higher, thereby promoting combustion and effectively reducing carbon monoxide.

[7] A method for manufacturing a joined body according to an aspect is a method for manufacturing a joined body (1) in which a component is fixed to a wall body (2), the method including:

a step of forming a through-hole (5) in the wall body (2) in a thickness direction of the wall body (2); and a step of allowing the component (3) to block the through-hole (5) from one surface (2*a*) of the wall body (2) and welding an inner peripheral surface (5*a*) of the through-hole (5) and the component (3) from the other surface (2*b*) side of the wall body (2), in which a welded portion (6) where the inner peripheral surface (5*a*) of the through-hole (5) and the component (3) are welded is accommodated in the through-hole (5).

According to the method for manufacturing a joined body of the present disclosure, welding can be performed on the wall body from a side opposite to the side on which the component is fixed. Therefore, workability of welding can be improved even in a case where it is difficult to perform welding from the side on which the component is fixed.

[8] A method for manufacturing a joined body according to another aspect is the method for manufacturing a joined body of [7], in which the wall body (3) is a tubular body (4, 11) having a tubular shape, and the one surface (2*a*) is an inner peripheral surface (4*a*, 11*a*) of the tubular body (4, 11).

According to such a method, even in a case where an inner diameter of the tubular body is small or in a case where a position at which the component is to be attached is a position deeper than an opening end of the tubular body, welding can be performed from an outer peripheral surface side of the tubular body. Therefore, the workability of welding can be improved.

[9] A method for manufacturing a combustor according to an aspect is a method for manufacturing a combustor (10) that includes a joined body (1) in which a component (3) is a throttle portion (12) that protrudes from an inner peripheral surface (11*a*) of a tubular body (11) toward a radial inner side of the tubular body (11), the method including: the method for manufacturing a joined body (1) according to claim 8.

According to the method for manufacturing a combustor of the present disclosure, even in a case where a position at which the throttle portion is to be attached is a position deeper than the opening end of the tubular body, welding can be performed from the outer peripheral surface side of the tubular body. Therefore, the workability of welding can be improved.

[10] A method for manufacturing a combustor according to another aspect is the method for manufacturing a combustor of [9], in which the tubular body (11) includes an inner wall portion (21) including the inner peripheral surface (11*a*) of the tubular body (11), and an outer wall portion (22) including an outer peripheral surface (11*b*) of the tubular body (11), the inner wall portion (21) and the outer wall portion (22) are provided at an interval in a thickness direction of the tubular body (11) so that a flow path (20) is formed therebetween, the through-hole (5) includes a first hole portion (23) formed to pass through the inner wall portion (21) in the thickness direction, a second hole portion (24) formed to pass through the outer wall portion (22) in the thickness direction, and an intermediate hole portion (25) forming a part of the flow path (20) between the first hole portion (23) and the second hole portion (24), the welded portion (6) is accommodated in the first hole portion (23), and the method further includes a step of fixing a lid portion (15) to the outer peripheral surface (11*b*) of the tubular body (11) to block the through-hole (5) after the step of welding the inner peripheral surface (5*a*) of the through-hole (5) and the component (3).

According to such a method, it is possible to check whether the welded portion is accommodated in the first hole portion before the lid portion is fixed. Therefore, it is possible to prevent the welded portion from blocking the flow path.

REFERENCE SIGNS LIST

1: Joined body
2: Wall body
2*a*: One surface (of wall body)
2*b*: The other surface (of wall body)
3: Component
4: Tubular body
4*a*: Inner peripheral surface (of tubular body)
4*b*: Outer peripheral surface (of tubular body)
5: Through-hole
5*a*: Inner peripheral surface (of through-hole)
6: Welded portion
10: Combustor
11: Tubular body
11*a*: Inner peripheral surface (of tubular body)
11*b*: Outer peripheral surface (of tubular body)
12: Throttle portion
14: Receiving surface
15: Lid portion
20: Flow path
21: Inner wall portion
22: Outer wall portion
23: First hole portion
24: Second hole portion
25: Intermediate hole portion
G: Combustion gas
L: Axial direction (of tubular body)
IP: Virtual plane
θ: Angle

The invention claimed is:

1. A combustor comprising a joined body,
the joined body comprising:
a wall body having a through-hole formed in a thickness direction; and
a component fixed to one surface of the wall body to block the through-hole,
wherein a welding filler material welded to fix the component to the one surface is accommodated in the through-hole,
wherein the wall body is a tubular body having a tubular shape, and the one surface is an inner peripheral surface of the tubular body,
wherein the tubular body includes:
an inner wall portion including the inner peripheral surface of the tubular body; and
an outer wall portion including an outer peripheral surface of the tubular body,
wherein the inner wall portion and the outer wall portion are provided at an interval in a thickness direction of the tubular body so that a flow path is formed therebetween,
wherein the through-hole includes;
a first hole portion formed to pass through the inner wall portion in the thickness direction;
a second hole portion formed to pass through the outer wall portion in the thickness direction; and
an intermediate hole portion forming a part of the flow path between the first hole portion and the second hole portion,
wherein the welding filler material is accommodated in the first hole portion, and
a lid portion is fixed to the outer peripheral surface of the tubular body to block the through-hole.

2. The combustor according to claim 1,
wherein the flow path is configured to allow a cooling medium to flow therethrough.

3. The combustor according to claim 1,
wherein the component is a throttle portion that protrudes from the inner peripheral surface of the tubular body toward a centerline of the tubular body,
the throttle portion has a receiving surface facing a combustion gas flowing through the tubular body, and
the receiving surface is inclined at an acute angle with respect to a virtual plane perpendicular to an axial direction of the tubular body.

4. A method for manufacturing a combustor, the method comprising a method for manufacturing a joined body in which a component is fixed to a wall body,
the method for manufacturing the joined body comprising:
a step of forming a through-hole in the wall body in a thickness direction of the wall body; and
a step of allowing the component to block the through-hole from one surface of the wall body and welding an inner peripheral surface of the through-hole and the component from the other surface side of the wall body,
wherein a welding filler material where the inner peripheral surface of the through-hole and the component are welded is accommodated in the through-hole,
wherein the wall body is a tubular body having a tubular shape, and the one surface is an inner peripheral surface of the tubular body,
wherein the combustor includes the joined body in which the component is a throttle portion that protrudes from an inner peripheral surface of a tubular body toward a centerline of the tubular body,
wherein the tubular body includes:
an inner wall portion including the inner peripheral surface of the tubular body; and
an outer wall portion including an outer peripheral surface of the tubular body,
wherein the inner wall portion and the outer wall portion are provided at an interval in a thickness direction of the tubular body so that a flow path is formed therebetween,
wherein the through-hole includes:
a first hole portion formed to pass through the inner wall portion in the thickness direction;
a second hole portion formed to pass through the outer wall portion in the thickness direction; and
an intermediate hole portion forming a part of the flow path between the first hole portion and the second hole portion,
wherein the welding filler material is accommodated in the first hole portion, and
the method further comprises a step of fixing a lid portion to the outer peripheral surface of the tubular body to block the through-hole after the step of welding the inner peripheral surface of the through-hole and the component.

* * * * *